US008015910B1

(12) United States Patent
Fuqua et al.

(10) Patent No.: US 8,015,910 B1
(45) Date of Patent: Sep. 13, 2011

(54) CONVERTIBLE BALLISTIC STRUCTURE WITH ARTICULATED PANELS

(75) Inventors: Charles L. Fuqua, Woodbridge, VA (US); Steven S. Kahre, Spotsylvania, VA (US)

(73) Assignee: Patriot3, Inc., Fredericksburg, VA (US)

( * ) Notice: Subject to any disclaimer, the term of this patent is extended or adjusted under 35 U.S.C. 154(b) by 218 days.

(21) Appl. No.: 12/456,307

(22) Filed: Jun. 15, 2009

(51) Int. Cl.
*F41H 5/14* (2006.01)

(52) U.S. Cl. ..... 89/36.09; 89/36.01; 89/36.07; 89/920; 89/936

(58) Field of Classification Search ..... 376/272; 250/506, 507
See application file for complete search history.

(56) References Cited

U.S. PATENT DOCUMENTS

| | | | | | |
|---|---|---|---|---|---|
| 23,212 | A | * | 3/1859 | Woodruff | 52/143 |
| 36,781 | A | * | 10/1862 | Hunter | 109/22 |
| 38,845 | A | * | 6/1863 | Saviers | 89/36.09 |
| 43,195 | A | * | 6/1864 | Goodwin | 89/36.09 |
| 1,203,962 | A | * | 11/1916 | Bellamore | 109/79 |
| 1,253,964 | A | * | 1/1918 | Hack | 52/143 |
| 1,281,400 | A | * | 10/1918 | Larnell | 89/36.09 |
| 1,875,488 | A | * | 9/1932 | Peters | 109/17 |
| 2,020,702 | A | * | 11/1935 | Russell | 2/2.5 |
| 2,151,033 | A | * | 3/1939 | Jones | 160/40 |
| 2,471,071 | A | * | 5/1949 | Mcdonald | 2/2.5 |
| 2,587,698 | A | * | 3/1952 | Corn, Jr. et al. | 160/135 |
| 2,693,655 | A | * | 11/1954 | Tschiedel | 40/610 |
| 2,746,188 | A | * | 5/1956 | Sweetnam | 40/614 |
| 2,820,318 | A | * | 1/1958 | Reynolds | 446/473 |
| 2,871,763 | A | * | 2/1959 | Blomquist | 89/36.08 |
| 3,232,370 | A | * | 2/1966 | Jaffe | 181/30 |
| 3,247,628 | A | * | 4/1966 | Miller | 52/6 |
| 3,478,643 | A | * | 11/1969 | Forsyth et al. | 89/36.08 |
| 3,820,294 | A | * | 6/1974 | Parker | 52/262 |
| 3,942,598 | A | * | 3/1976 | Council | 180/6.5 |
| 4,351,558 | A | * | 9/1982 | Mueller | 296/203.01 |
| 4,412,495 | A | * | 11/1983 | Sankar | 109/49.5 |
| H7 | H | * | 1/1986 | Martone | 2/2.5 |
| 4,674,394 | A | * | 6/1987 | Martino | 89/36.05 |
| 4,677,896 | A | * | 7/1987 | Litvinoff | 296/187.07 |
| 4,781,101 | A | * | 11/1988 | Zevuluni et al. | 89/36.09 |
| 4,782,735 | A | * | 11/1988 | Mui et al. | 89/36.07 |
| 4,896,473 | A | * | 1/1990 | Liebetrau | 52/748.11 |
| 4,934,246 | A | * | 6/1990 | Benson et al. | 89/36.14 |
| 4,949,490 | A | * | 8/1990 | Miller | 40/605 |
| 5,377,577 | A | * | 1/1995 | Bounkong et al. | 89/36.05 |
| 5,392,686 | A | * | 2/1995 | Sankar | 89/36.05 |
| D359,820 | S | * | 6/1995 | Thumb et al. | D29/100 |
| 5,429,432 | A | * | 7/1995 | Johnson | 312/235.3 |

(Continued)

FOREIGN PATENT DOCUMENTS

WO WO 9429665 A1 * 12/1994

*Primary Examiner* — Michael Carone
*Assistant Examiner* — Joshua Freeman
(74) *Attorney, Agent, or Firm* — Schwartz Law Firm, P.C.

(57) ABSTRACT

A convertible ballistic structure has a threat side and a protected side. The ballistic structure includes a body panel assembly, and at least one movable side panel assembly adjacent the body panel assembly. Means are provided for articulating the side panel assembly relative to the body panel assembly, whereby the ballistic structure is convertible between a contracted condition and an expanded condition. In the contracted condition, the side panel assembly extends rearwardly from the body panel assembly and outwardly from the protected side of the ballistic structure. In the expanded condition, the side panel assembly extends outwardly substantially coplanar to the body panel assembly.

17 Claims, 9 Drawing Sheets

U.S. PATENT DOCUMENTS 5,492,476 A * 2/1996 Ball et al. ..... 434/408
6,000,347 A * 12/1999 Madden, Jr. ..... 109/49.5
6,435,253 B1 * 8/2002 Steeves et al. ..... 160/135
6,553,698 B1 * 4/2003 Kemeny ..... 40/610
6,581,505 B1 * 6/2003 Levell ..... 89/36.07
6,622,607 B1 * 9/2003 Miller ..... 89/36.07
6,647,652 B1 * 11/2003 Seiber et al. ..... 40/606.1
6,711,980 B2 * 3/2004 Kropf ..... 89/36.09
6,802,576 B2 * 10/2004 Shepherd ..... 312/117
6,807,890 B1 * 10/2004 Fuqua ..... 89/36.02
6,845,701 B2 * 1/2005 Drackett ..... 89/36.09
7,159,503 B1 * 1/2007 Weatherwax ..... 89/36.04
7,302,880 B1 * 12/2007 Elasic ..... 89/36.07
2002/0092416 A1 * 7/2002 Cohen et al. ..... 89/36.05
2007/0283477 A1 * 12/2007 Dovner ..... 2/2.5
2009/0120273 A1 * 5/2009 Eckdahl et al. ..... 89/36.08
2010/0089229 A1 * 4/2010 Ackerman et al. ..... 89/36.04

* cited by examiner

CONVERTIBLE BALLISTIC STRUCTURE WITH ARTICULATED PANELS

TECHNICAL FIELD AND BACKGROUND

The present disclosure relates broadly to a convertible ballistic structure with one or more articulated panels.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

According to one exemplary embodiment, the disclosure comprises a convertible ballistic structure having a threat side and a protected side. The ballistic structure includes a body panel assembly, and at least one movable side panel assembly adjacent the body panel assembly. Means are provided for articulating the side panel assembly relative to the body panel assembly, whereby the ballistic structure is convertible between a contracted condition and an expanded condition. In the contracted condition, the side panel assembly extends rearwardly from the body panel assembly and outwardly from the protected side of the ballistic structure. In the expanded condition, the side panel assembly extends outwardly substantially coplanar to the body panel assembly.

According to another exemplary embodiment, the body panel assembly comprises interconnected upper and lower ballistic body panels.

According to another exemplary embodiment, the upper body panel defines a weapon port.

According to another exemplary embodiment, the upper body panel defines a vision port.

According to another exemplary embodiment, a transparent ballistic shield is located at the vision port.

According to another exemplary embodiment, a bezel surrounds the ballistic shield at the vision port.

According to another exemplary embodiment, a plurality of wheels are located at a base of the body panel assembly.

According to another exemplary embodiment, the side panel assembly includes upper and lower ballistic side panels hinged to respective upper and lower body panels of the body panel assembly.

According to another exemplary embodiment, the means for articulating the movable side panel assembly comprises a pivoted control arm assembly. Alternatively, other suitable means including an electric gear-driven automatic system with appropriate panel links may be employed to articulate the side panel assembly. Further means for articulating the side panel assembly may comprise a protected-side handle operatively connected to the side panel assembly, and designed for being grasped by a user to move the side panel assembly.

According to another exemplary embodiment, the control arm assembly comprises an operator handle, a main control arm pivotably connected to the body panel assembly, and a side panel link connected to the movable side panel assembly and the main control arm.

In yet another exemplary embodiment, the disclosure comprises a convertible ballistic structure having a threat side and a protected side, and comprising a body panel assembly, and first and second movable side panel assemblies. The first and second side panel assemblies are attached to the body panel assembly, and are located adjacent respective opposing side edges of the body panel assembly. Means are provided for simultaneously articulating the first and second side panel assemblies relative to the body panel assembly, whereby the ballistic structure is convertible between a contracted condition and an expanded condition. In the contracted condition, the first and second side panel assemblies extend rearwardly from the body panel assembly and outwardly from the protected side of the ballistic structure. In the expanded condition, the first and second side panel assemblies extend outwardly substantially coplanar to the body panel assembly.

According to another exemplary embodiment, a threat side surface area of the ballistic structure in the expanded condition is at least 50% greater than a threat side surface area of the ballistic structure in the contracted condition.

According to another exemplary embodiment, the first and second movable side panel assemblies are substantially identical.

According to another exemplary embodiment, the means for simultaneously articulating the first and second movable side panel assemblies comprises a pivoted control arm assembly. Alternative means, such as that discussed above, may also be employed for simultaneously articulating the side panel assemblies.

In yet another exemplary embodiment, the disclosure comprises a method for shielding a user against a ballistic threat. The method includes locating a convertible ballistic structure between the user and a source of the ballistic threat. The ballistic structure having a threat side and a protected side, and comprises a body panel assembly, and at least one movable side panel assembly adjacent the body panel assembly. The side panel assembly is articulated relative to the body panel assembly to selectively convert the ballistic structure between a contracted condition and an expanded condition. In the contracted condition, the side panel assembly extends rearwardly from the body assembly and outwardly from the protected side of the ballistic structure. In the expanded condition, the side panel assembly extends outwardly substantially coplanar to the body panel assembly.

BRIEF DESCRIPTION OF THE DRAWINGS

The description of exemplary embodiments proceeds in conjunction with the following drawings, in which.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list. Additionally, the terms "operator", "user", and "individual" may be used interchangeably herein unless otherwise made clear from the context of the description.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
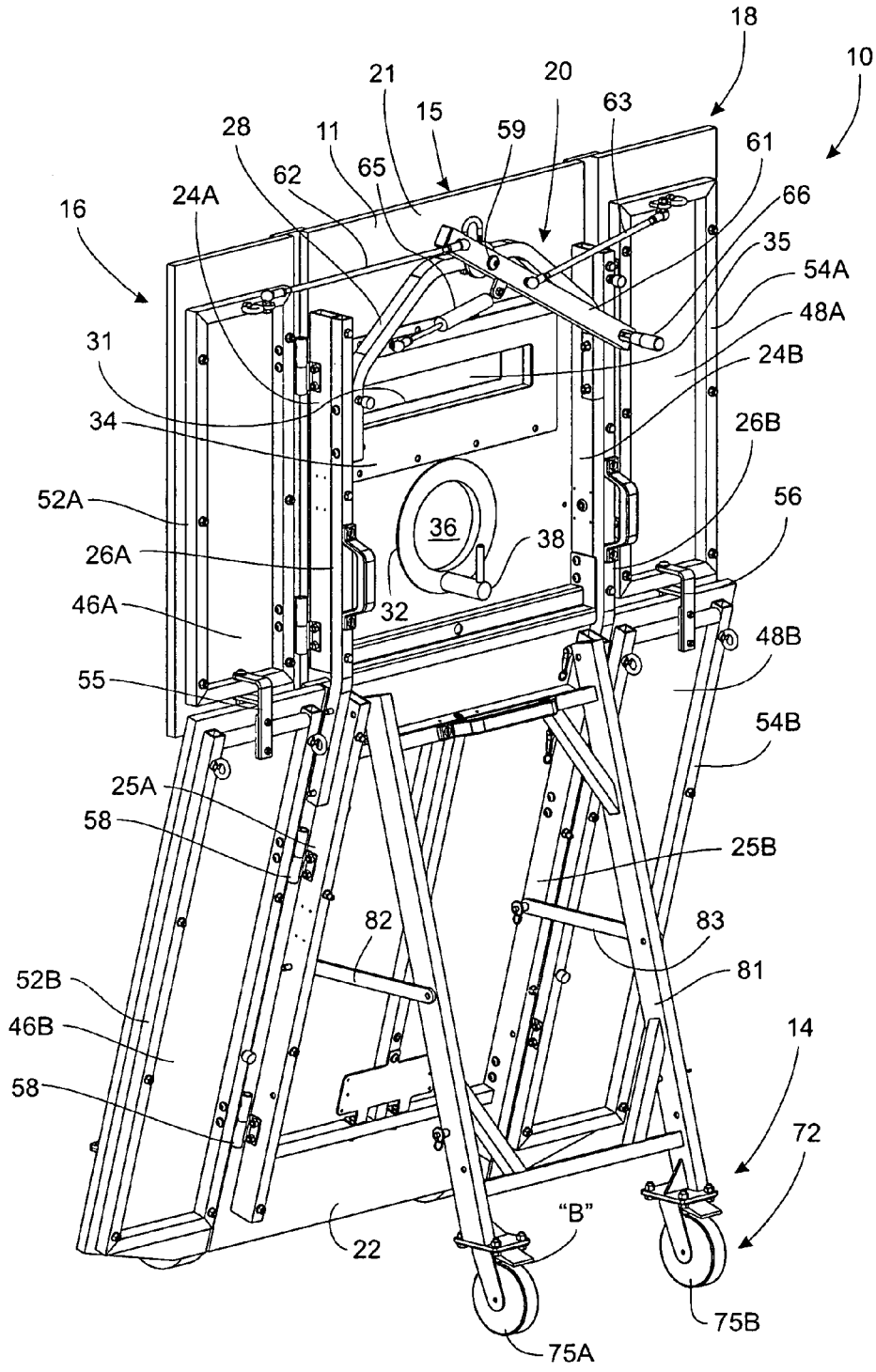
FIG. 1 is a protected-side perspective view of a convertible ballistic structure in its expanded condition according to one exemplary embodiment of the present disclosure.
Figure 2:
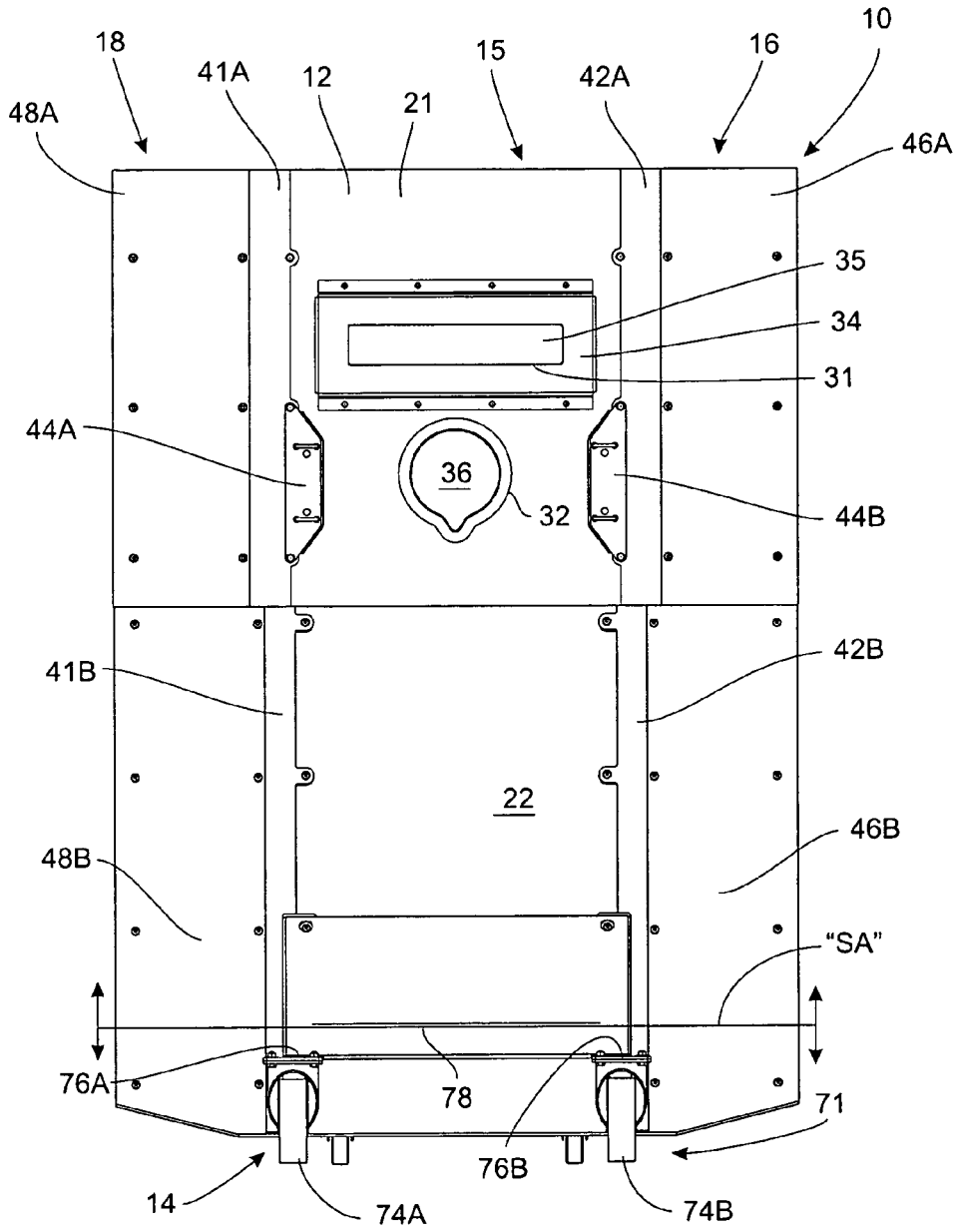
FIG. 2 is a threat-side elevation of the exemplary ballistic structure in the expanded condition.
Figure 3:
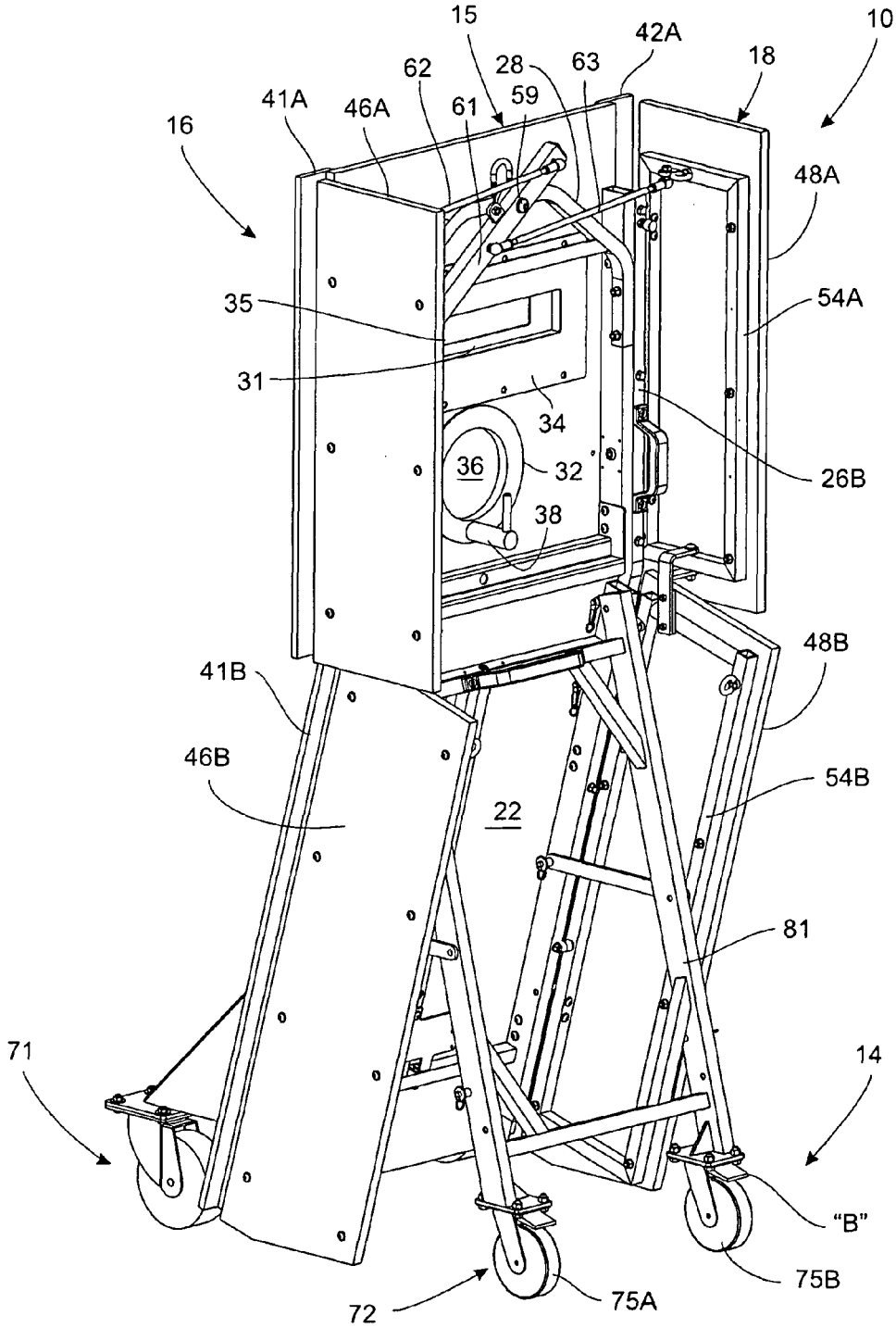
FIG. 3 is a protected-side perspective view of the exemplary ballistic structure in its contracted condition.

Referring now specifically to the drawings, a mobile and convertible ballistic structure according to one exemplary embodiment of the present invention is illustrated in FIGS. 1 and 2, and shown generally at reference numeral 10. The exemplary ballistic structure 10 has a protected side 11 (FIG. 1) and an opposing threat side 12 (FIG. 2), and comprises a wheeled base assembly 14, a body panel assembly 15 carried by the base assembly 14, and first and second movable side panel assemblies 16 and 18. The side panel assemblies 16, 18 are located adjacent respective opposing side edges of the body panel assembly 15. A pivoted control arm assembly 20, shown in FIG. 1, is arranged on the protected side 11 of the convertible ballistic structure 10, and is designed to be manually actuated by an operator, as described below, to simultaneously articulate the first and second side panel assemblies 16, 18 relative to the body panel assembly 15, such that the ballistic structure 10 is convertible between an expanded condition (e.g., FIGS. 1 and 2) and a contracted condition (e.g., FIG. 3). In the contracted condition shown in FIG. 3, the first and second side panel assemblies 16, 18 extend rearwardly from the body panel assembly 15 and perpendicularly outward from the protected side 11 of the ballistic structure 10. In the expanded condition shown in FIGS. 1 and 2, the first and second side panel assemblies 16, 18 extend outwardly substantially coplanar to the body panel assembly 15.

Figure 4:
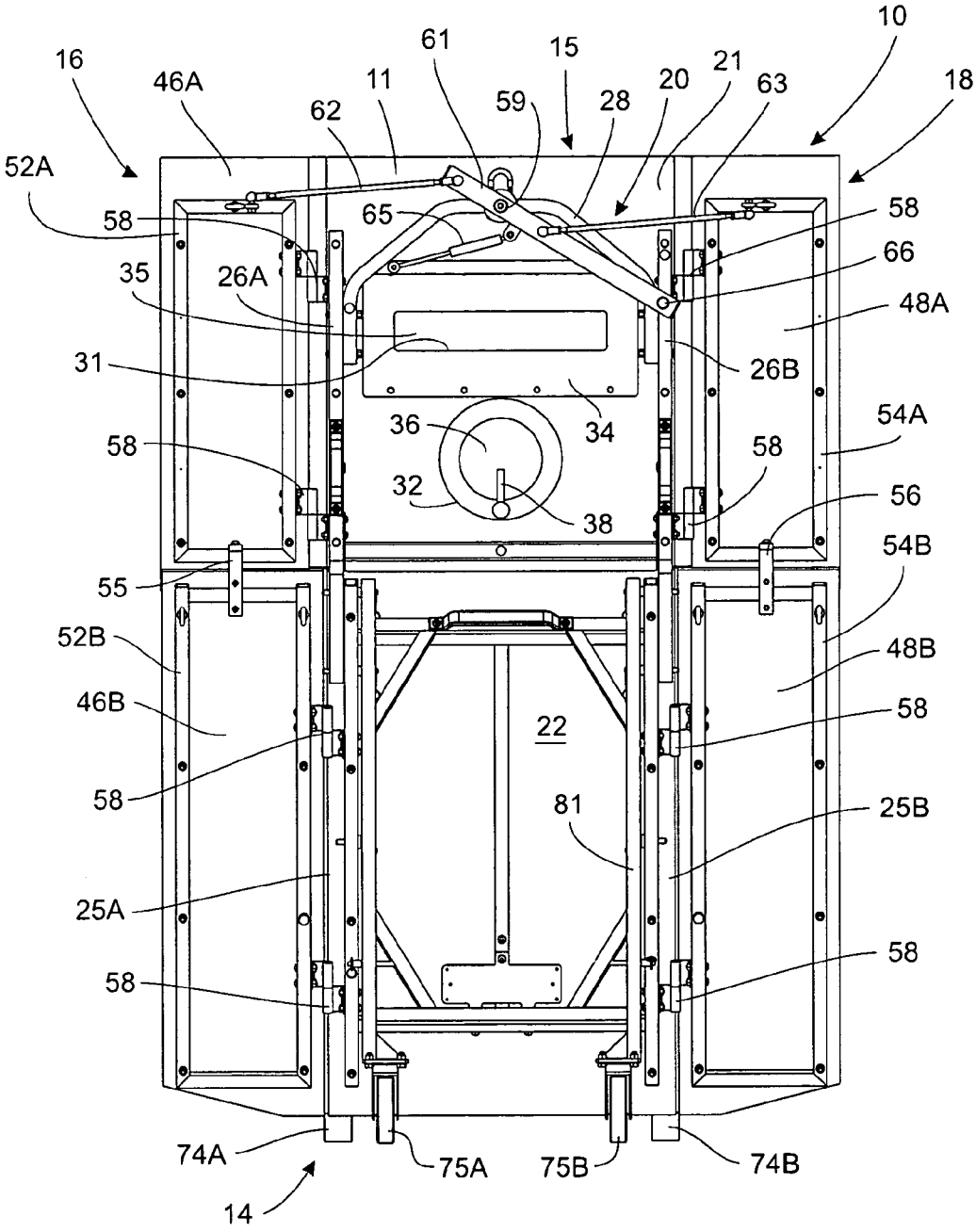
FIG. 4 is a protected-side elevation of the exemplary ballistic structure in the expanded condition.

As best shown in FIGS. 1 and 4, the body panel assembly 15 of the exemplary embodiment comprises separate upper and lower continuous, solid, ballistic panels 21 and 22 supported vertically and reinforced by an arrangement of protected-side metal frame elements 24A, 24B, 25A, 25B, 26A, 26B. Frame elements 24A, 24B and 25A, 25B mount respectively to the upper and lower ballistic panels 21 and 22, and are interconnected by frame elements 26A, 26B. These frame elements 26A, 26B have inwardly-angled ends which orient the lower ballistic panel 22 at a slight outward angle relative to the upper ballistic panel 21. An inverted generally U-shaped cross bar 28 extends between the frame elements 24A, 24B of the upper ballistic panel 21, and serves to operatively connect the control arm assembly 20 discussed further below. Additionally, the upper ballistic panel 21 may define an elongated rectangular vision port 31 and a generally annular weapon port 32. A rigid metal bezel 34 and transparent ballistic shield 35 are located at the vision port 31, while the weapon port 32 may be temporarily covered by a removable solid metal plate 36 having an outwardly extending protected-side handle 38.

Figure 5:
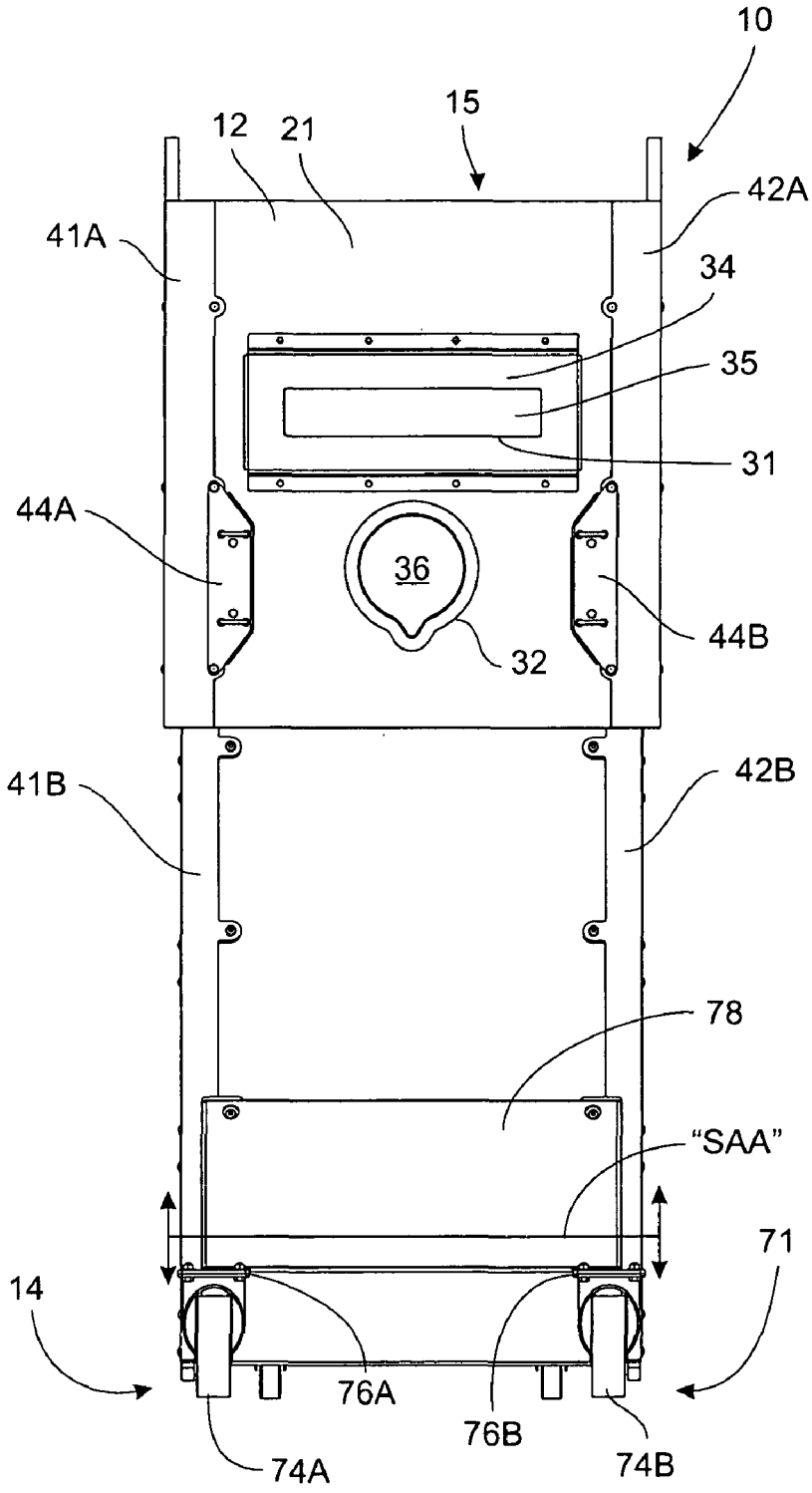
FIG. 5 is a threat-side elevation of the exemplary ballistic structure in the contracted condition.

Elongated metal joint protectors 41A, 42A and 416, 42B, shown in FIGS. 2 and 5, may be affixed to both the upper and lower body panels 21, 22 on the threat side 12 of the ballistic structure 10, such that in the expanded condition of the convertible ballistic structure 10, the joint protectors 41A, 42A and 41B, 42B close any longitudinal gaps formed between the body panel assembly 15 and side panel assemblies 16, 18. Additional reinforcement plates 44A, 44B may also be affixed to the upper ballistic panel 21 adjacent respective joint protectors 41A, 416.

Referring again to FIGS. 1 and 4, the side panel assemblies 16, 18 comprise respective identical pairs of upper and lower ballistic side panels 46A, 46B and 48A, 48B located adjacent opposing longitudinal side edges of the upper and lower body panels 21, 22 of the body panel assembly 15. Each ballistic side panel 46A, 46B, 48A, 48B comprises a generally rectangular protected-side metal frame 52A, 52B, 54A, 54B, respectively. The metal frames 52A, 52B, 54A, 54B of respective upper and lower side panels 46A, 46B, 48A, 48B are interconnected by brackets 55 and 56, and pivotably carried by frame elements 24A, 24B, 25A, 25B of the upper and lower body panels 21, 22 using metal hinges 58.

As indicated above, the control arm assembly 20 is pivotably connected to the inverted U-shaped cross bar 28 extending between the protected-side frame elements 24A, 24B of the upper ballistic panel 21. An attachment bolt 59 extends through a main control arm 61 and the cross bar 28, and defines a pivot point about which the main control arm 61 pivots. Elongated side panel control links 62, 63 operatively interconnect the main control arm 61 and the movable side panel assemblies 16, 18. A pneumatic (or hydraulic) cylinder 65 attaches to the main control arm 61 and cross bar 28, and serves to regulate pivoting movement of the main control arm 61 such that the side panel assemblies 16, 18 remain in their intended extended or contracted position without substantial inadvertent movement.

Figure 6:
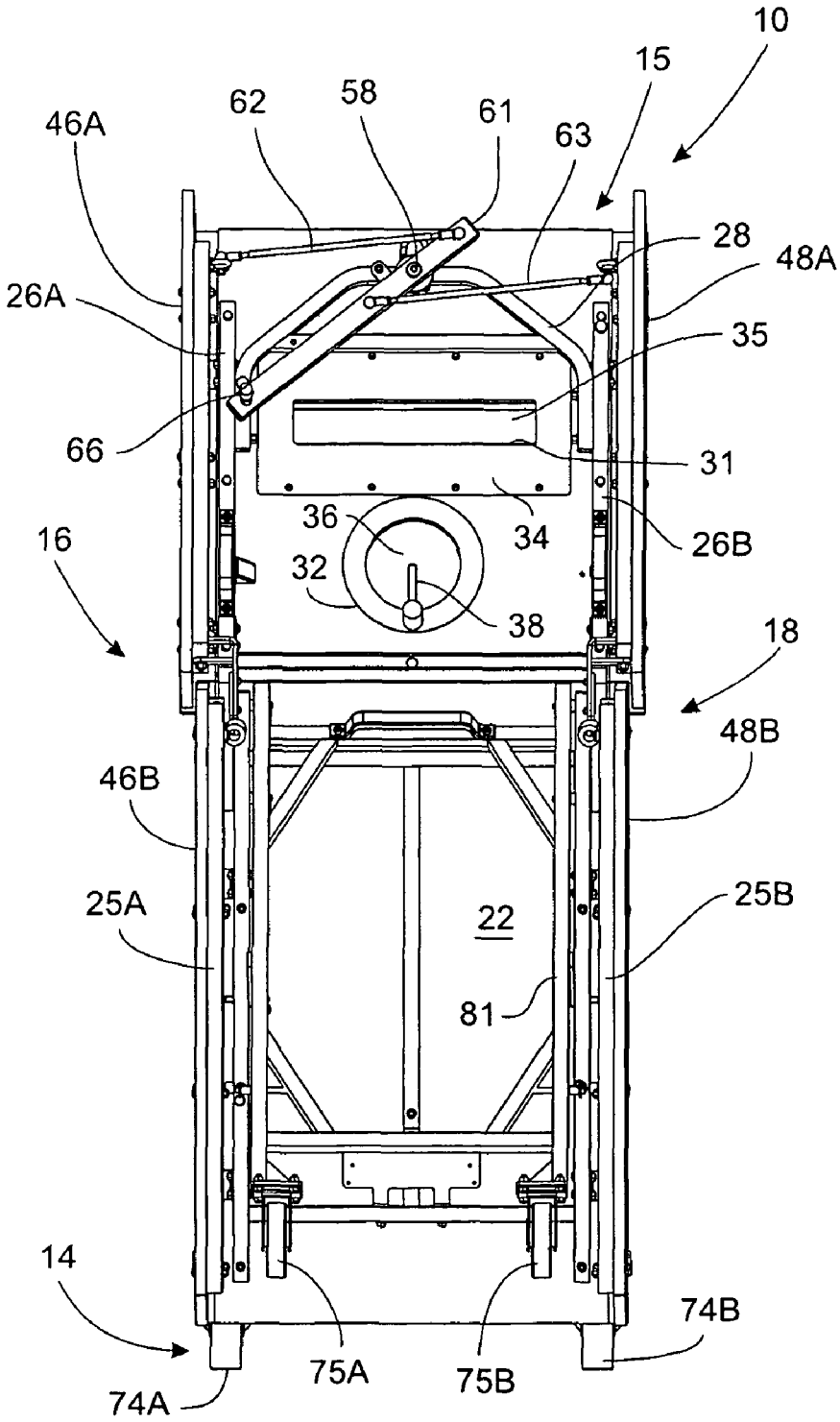
FIG. 6 is a protected-side elevation of the exemplary ballistic structure in the contracted condition.
Figure 7:
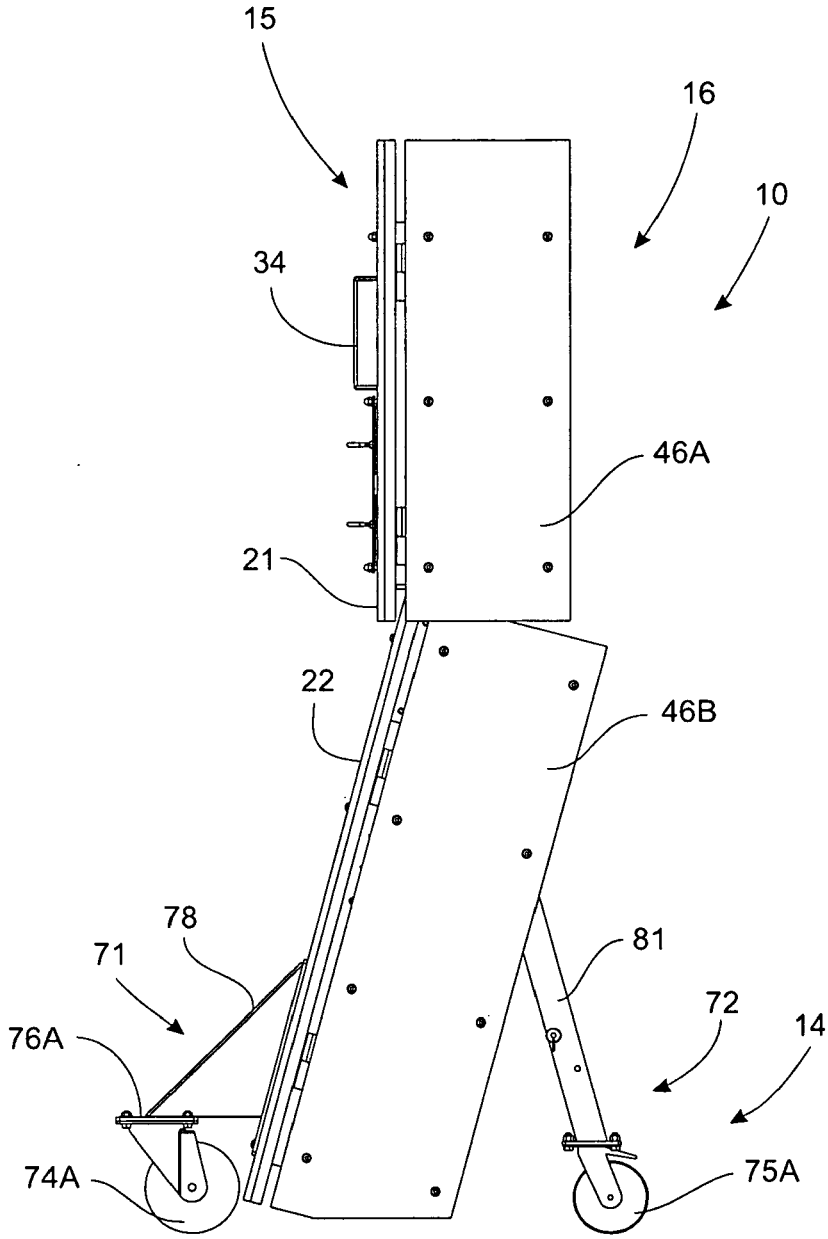
FIG. 7 is a side elevation of the exemplary ballistic structure in the contracted condition.
Figure 8:
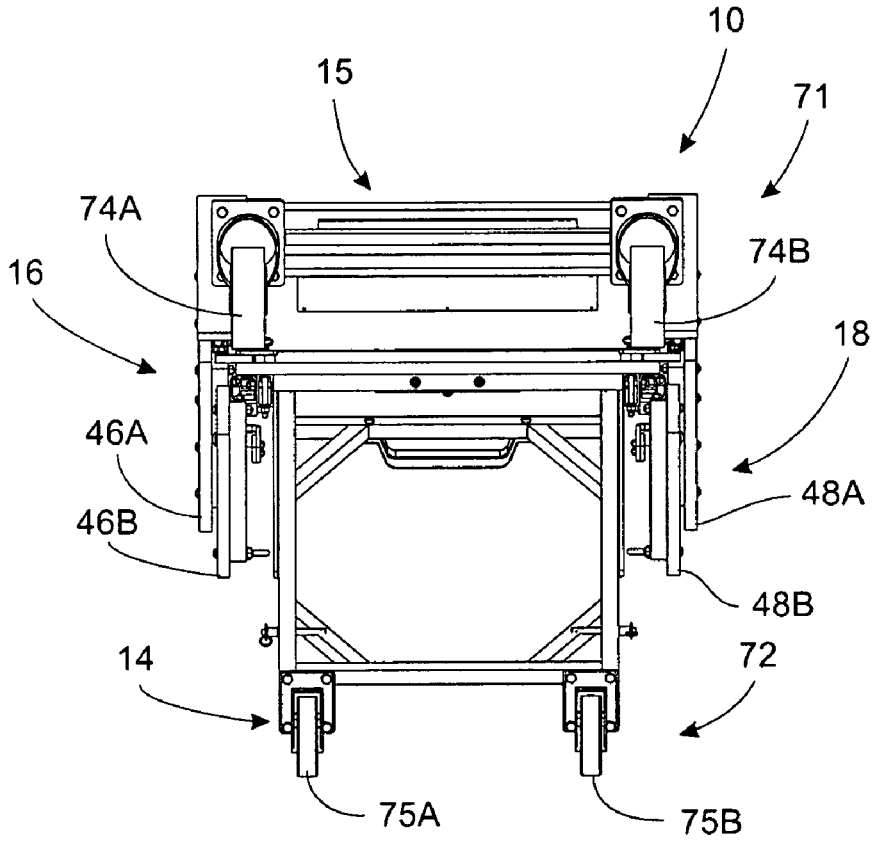
FIG. 8 is bottom end view of the exemplary ballistic structure in the contracted condition.

Conversion of the ballistic structure 10 from the expanded condition (See FIG. 4) to the contracted condition (See FIG. 6) is effected by an individual safely positioned on the protected side 11 of the ballistic structure 10. The individual manually converts the ballistic structure 10 by grasping a handle 66 projecting from one end of the main control arm 61, and pivoting the control arm 61 such that its handle end moves downwardly along an approximately 45-degree arcuate path. This arcuate movement compresses the cylinder 65, and causes the side panel control links 62, 63 to simultaneously pivot the hinged side panel assemblies 16, 18 rearwardly from the body panel assembly 15 and outwardly from the protected side 11 of the ballistic structure 10. Both side panel assemblies 16, 18 (joined upper and lower ballistic side panels 46A, 46B, 48A, 48B) move in unison upon manual actuation of the control arm assembly 20 to a point substantially perpendicular to the body panel assembly 15. The convertible ballistic structure 10 may be returned to its expanded condition by reverse operation of the control arm assembly 20.

In the contracted condition shown in FIGS. 3, 6, 7, and 8, the convertible ballistic structure 10 creates a multi-sided ballistic barrier capable of protecting an individual against ballistic threats from the front and sides. When converted to the expanded condition shown in FIGS. 1, 2, 4, and 9, the ballistic structure 10 defines an increased substantially planar threat side surface area "SA". In one embodiment, the planar front threat side surface area "SA" of the ballistic structure 10 in the expanded condition (See FIG. 2) is at least 50% greater than a front threat side surface area "SAA" of said ballistic structure 10 in the contracted condition (See FIG. 5).

Figure 9:
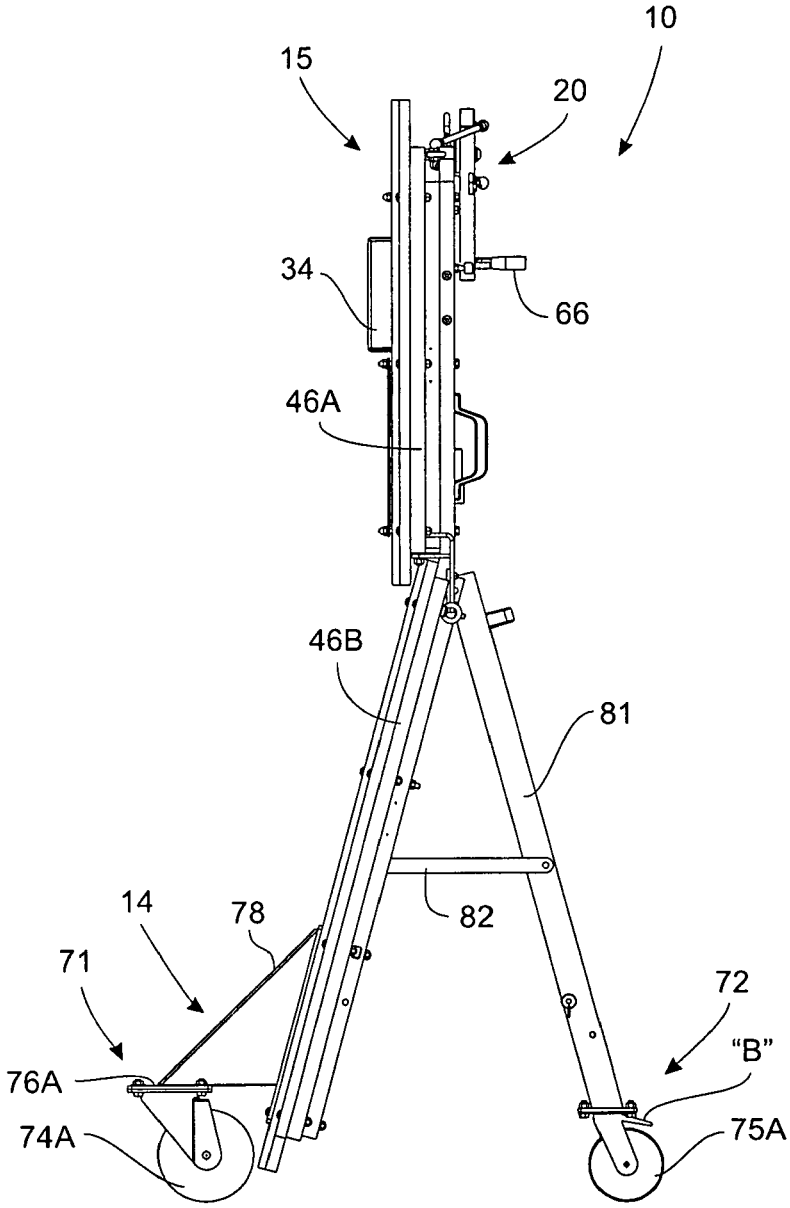
FIG. 9 is a side elevation of the exemplary ballistic structure in the expanded condition.

The wheeled base assembly 14 of the convertible ballistic structure 10 promotes ready and convenient field transport from one location to another. As best shown in FIGS. 1, 2 and 9, the exemplary base assembly 15 comprises separate front and rear wheel assemblies 71, 72, each comprising a pair of spaced caster wheels 74A, 74B and 75A, 75B. The front wheels 74A, 74B are located forward of the body panel assembly 15 on the threat side 12 of the ballistic structure 10, while the rear wheels 75A, 75B are located rearward of the body panel assembly 15 on the protected side 12 of the ballistic structure 10. The front wheels 74A, 74B are rotatably carried on respective support feet 76A, 76B affixed to and projecting from the longitudinal metal joint protectors 41B, 42B attached to the body panel assembly 15 on the threat side 12 of the ballistic structure 10. A front wheel support plate 78 may attached to and extend between the spaced support feet 76A, 76B for added reinforcement. Referring again to FIG. 1, the rear wheel assembly 72 comprises a pivoted support stand 81 connected to spaced longitudinal metal frame elements 25A, 25B attached to the body panel assembly 15 on the protected side 11 of the ballistic structure 10. Respective spacer links 82, 83 interconnect the pivoted support stand 81 and frame elements 25A, 25B, and function to properly position the rear wheels 75A, 75B relative to the front wheels 74A, 74B. Conventional wheel brakes "B" may be located on one or both pairs of front and rear caster wheels 74A, 74B, 75A, 75B.

Each of the ballistic panels 21, 22, 46A, 46B, 48A, 48B incorporated in the ballistic structure 10 may be constructed of any desired hard or soft armor material including, for example, ballistic fabrics, hard armor plates, and/or combinations of both. The particular ballistic material used may be chosen based on specifications for protecting against any number of predefined threat levels.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

We claim:

1. A convertible ballistic structure having a threat side and a protected side, comprising:

a body panel assembly;

at least one movable side panel assembly adjacent said body panel assembly; and a pivoted control arm assembly for articulating said side panel assembly relative to said body panel assembly, whereby said ballistic structure is convertible between a contracted condition and an expanded condition, such that:

(I) in the contracted condition, said side panel assembly extends rearwardly from said body panel assembly and outwardly from the protected side of said ballistic structure; and (ii) in the expanded condition, said side panel assembly extends outwardly substantially coplanar to said body panel assembly.

2. A convertible ballistic structure according to claim 1, wherein said body panel assembly comprises interconnected upper and lower ballistic body panels.

3. A convertible ballistic structure according to claim 2, wherein said upper body panel defines a weapon port.

4. A convertible ballistic structure according to claim 2, wherein side panel assembly comprises upper and lower ballistic side panels hinged to respective upper and lower body panels of said body panel assembly.

5. A convertible ballistic structure according to claim 2, wherein said upper body panel defines a vision port.

6. A convertible ballistic structure according to claim 5, and comprising a transparent ballistic shield located at said vision port.

7. A convertible ballistic structure according to claim 6, and comprising a bezel surrounding said ballistic shield at said vision port.

8. A convertible ballistic structure according to claim 1, and comprising a plurality of wheels located at a base of said body panel assembly.

9. A convertible ballistic structure according to claim 1, wherein said control arm assembly comprises an operator handle, a main control arm pivotably connected to said body panel assembly, and a side panel link connected to said movable side panel assembly and said main control arm.

10. A convertible ballistic structure having a threat side and a protected side, comprising:

a body panel assembly;

first and second movable side panel assemblies located adjacent respective side edges of said body panel assembly; and a pivoted control arm assembly for simultaneously articulating said first and second side panel assemblies relative to said body panel assembly, whereby said ballistic structure is convertible between a contracted condition and an expanded condition, such that:

(I) in the contracted condition, said first and second side panel assemblies extend rearwardly from said body panel assembly and outwardly from the protected side of said ballistic structure; and (ii) in the expanded condition, said first and second side panel assemblies extend outwardly substantially coplanar to said body panel assembly.

11. A convertible ballistic structure according to claim 10, wherein a threat side surface area of said ballistic structure in the expanded condition is at least 50% greater than a threat side surface area of said ballistic structure in the contracted condition.

12. A convertible ballistic structure according to claim 10, wherein said first and second movable side panel assemblies are substantially identical.

13. A convertible ballistic structure according to claim 10, and comprising a plurality of wheels located at a base of said body panel assembly.

14. A convertible ballistic structure according to claim 10, wherein said body panel assembly comprises interconnected upper and lower ballistic body panels.

15. A convertible ballistic structure according to claim 14, wherein said upper body panel defines a weapon port.

16. A convertible ballistic structure according to claim 14, wherein said upper body panel defines vision port.

17. A convertible ballistic structure according to claim 14, wherein each of said first and second side panel assemblies comprises upper and lower ballistic side panels hinged to respective upper and lower ballistic body panels.

* * * * *